United States Patent [19]

Loevinger

[11] Patent Number: 4,480,370

[45] Date of Patent: Nov. 6, 1984

[54] HEATED RAILROAD TANK CAR

[76] Inventor: Richard P. Loevinger, P.O. Box 68, Brandon, S. Dak. 57005

[21] Appl. No.: 385,869

[22] Filed: Jun. 7, 1982

[51] Int. Cl.[3] ..... B23K 28/00; B23P 6/00; B23P 15/00

[52] U.S. Cl. ..... 29/401.1; 29/455 R; 29/469; 105/360; 105/451; 126/378; 165/41

[58] Field of Search ..... 15/246.5; 29/157.3 R, 29/157.4, 455 R, 401.1, 469; 105/247, 358, 360, 451; 126/343.5 A, 378, 443.5 R; 165/41, 169; 280/5 G, 5 C, 5 D, 5 E; 296/184; 432/13

[56] References Cited

U.S. PATENT DOCUMENTS

| | | | |
|---|---|---|---|
| 1,706,084 | 3/1929 | Steinmeyer et al. | 126/343.5 A |
| 2,145,614 | 1/1939 | Stambaugh | 105/247 X |
| 2,545,371 | 3/1951 | Mojonnier et al. | 165/169 X |
| 2,558,648 | 6/1951 | Gausmann | 105/358 |
| 2,624,553 | 1/1953 | Thompson et al. | 126/343.5 A |
| 2,772,784 | 12/1956 | Cyphers et al. | 15/246.5 |
| 3,143,108 | 8/1964 | Rogers | 126/378 X |
| 3,176,764 | 4/1965 | Barbera | 105/451 X |
| 3,228,466 | 1/1966 | Carletor | 105/451 X |
| 3,255,517 | 6/1966 | Barbera | 29/469 X |
| 3,479,724 | 11/1969 | Kruizenga et al. | 29/469 X |
| 3,503,381 | 3/1970 | Role | 126/343.5 A |
| 3,595,307 | 7/1971 | Momatt-Larssen | 165/169 X |
| 3,685,458 | 8/1972 | Price et al. | 105/451 X |
| 3,742,866 | 7/1973 | Needham et al. | 105/360 |

*Primary Examiner*—Howard Beltran

[57] ABSTRACT

A method of converting a tank such as a railway tank car into a heated tank to facilitate dispensing a congealable stored medium, wherein at least one end portion of the tank is removed and an elongated heat exchanger is inserted into the tank through the opened end. The heat exchanger is secured within the tank, a pre-determined distance from the bottom of the tank to define with the bottom a dead air space, the heat exchanger extending substantially longitudinally and transverselly across the entire bottom of the tank and downwardly sloping and extending to a drain valve. The heat exchanger is positioned in a sealed relationship with the walls of the tank. Thereafter, the portion of the removed end of the tank is replaced in a sealed relationship with the heat exchanger. The method includes a particular positioning of the heat exchanger in a heat relationship with the drain valve. The method further includes the positioning of inlet-outlet openings in the heat exchanger adjacent the drain valve.

4 Claims, 6 Drawing Figures

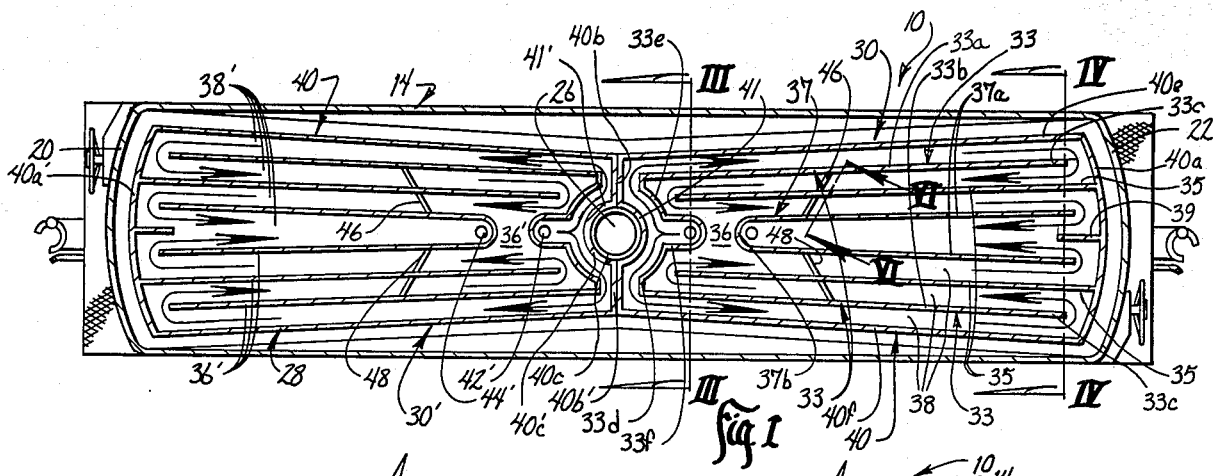
Fig. I
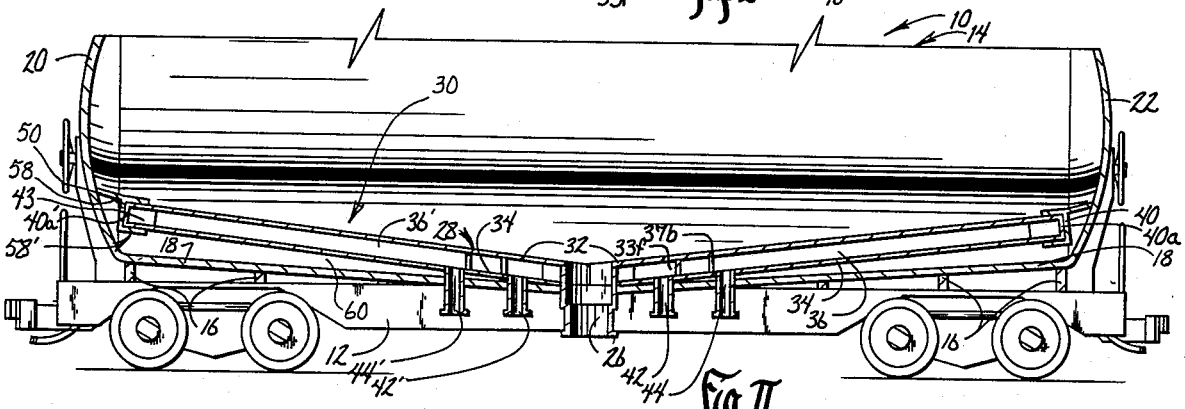
Fig. II
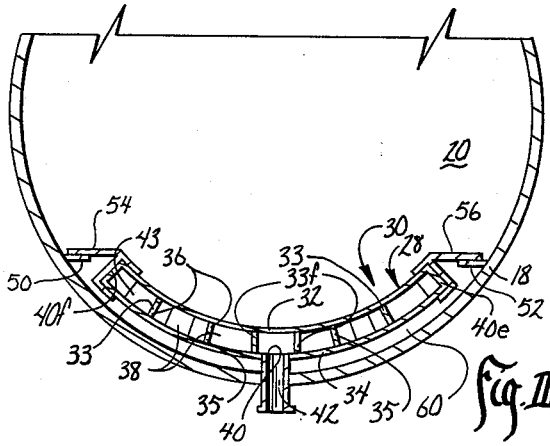
Fig. III
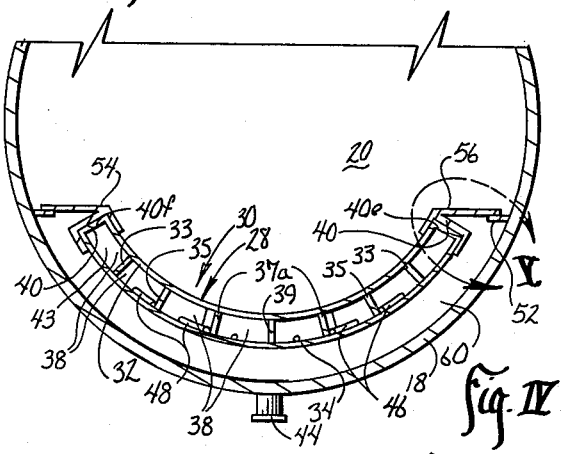
Fig. IV
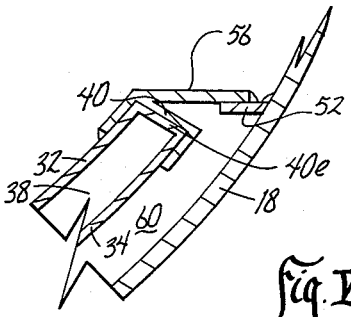
Fig. V
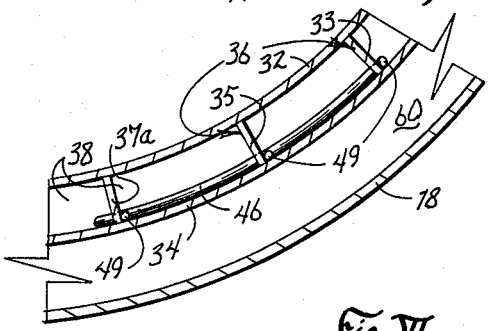
Fig. VI

HEATED RAILROAD TANK CAR

BACKGROUND OF THE INVENTION

This invention relates to a heated railway tank car and more particularly to a heated tank car having the heat exchanger assembly provided therein.

Railway tank cars are commonly used to transport liquid commodities that must be heated to enable the material to flow and unload through the bottom or top mounted discharge valve. At the present time, the material is heated by steam which passes through coils positioned on the exterior surface of the car or by coils which are positioned in the interior of the car. Typical of the prior art devices may be found in the following patents: U.S. Pat. No. 2,145,614 discloses internal and external heating coils. U.S. Pat. No. 2,558,648 shows a heating coil secured exteriorly to a lower portion of a tank car. U.S. Pat. No. 2,772,784 describes the use of a cylindrical jacket encompassing the tank car for the purpose of applying heating from hot water flowing through the jacket. U.S. Pat. No. 3,142,108 shows a plurality of pans attached to the bottom portion of a truck trailer tank for supplying heat to the tank. U.S. Pat. No. 3,176,764 describes an integral-coil tank wall section associated with the lower portion of a tank car to transfer heat to the tank car. U.S. Pat. No. 3,228,466 shows an external heating arrangement for a storage tank. U.S. Pat. No. 3,595,307 shows another arrangement of a heating system disposed exteriorly of a tank car. Finally, U.S. Pat. No. 3,685,458 describes a heating assembly secured exteriorly to a bottom portion of a tank car.

It is apparent from the above-identified patents that there are large areas of the cars that are not subject to the heated steam and that the tank saddles and underframes attached to the bottom end of the tank act as large heat sinks which radiate heat out to the air rather than inwardly to the product. A problem also associated with the external and internal coils is that they are substantially horizontally disposed which makes them difficult to drain after the steam has been disconnected thereby causing freezing and corrosion and subsequent failure to the coils.

Still another problem associated with the prior art is that the material at the upper end of the tank is heated at the same time as the material at the bottom of the tank. The material at the upper portion of the tank is heated for longer than is desirable since the material will not begin to flow from the tank until the material around the discharge valve has been sufficiently heated to enable it to flow from the tank. Still another problem associated with the prior art devices is that a "boot" of material is formed in the bottom end of the car. The "boot" forms due to the heat sink effect of the steel attached to the tank at this particular location. The "boot" is the product remaining in the car after the car has been unloaded and the "boot" keeps building or accumulating thereby reducing the effective capacity of the car. At some time, the "boot" must be removed by chipping or other manual removal process.

Therefore, it is a principal object of the invention to provide an improved heated tank car.

A further object of the invention is to provide a heated tank car having a heat exchanger provided in the interior thereof with the heat exchanger being spaced above the bottom of the tank to achieve a more efficient and uniform heating of the material.

A still further object of the invention is to provide a heated tank car which eliminates the heat sink problems normally associated with conventional heated tank cars.

Still another object of the invention is to provide a heat exchanger for a tank car which is sloped towards the middle of the car so that condensate will drain from the heat exchanger thereby reducing corrosion of the heat exchanger.

Still another object of the invention is to provide a heated tank car which prevents the formation of a "boot" at the bottom of the car.

Still another object of the invention is to provide a heated tank car employing an inclined heat exchanger therein to assist the flow of material to the discharge valve of the car.

These and other objects will be apparent to those skilled in the art.

BRIEF DESCRIPTION OF THE DRAWINGS

FIG. 1 is a plan longitudinal sectional view of the tank car and heat exchanger therein:

FIG. 2 is a partial side longitudinal sectional view of the car and heat exchanger:

FIG. 3 is an enlarged sectional view taken on lines 3—3 of FIG. 1:

FIG. 4 is an enlarged sectional view taken on lines 4—4 of FIG. 1:

FIG. 5 is an enlarged sectional view taken on lines 5—5 of FIG. 4; and FIG. 6 is an enlarged sectional view taken on lines 6—6 of FIG. 1.

SUMMARY OF THE INVENTION

A heated tank car is disclosed which has a heat exchanger means positioned therein above the bottom of the tank. The heat exchanger comprises a pair of heat exchanger units which are secured to and supported by the ends and side walls of the tank and which extend downwardly from the ends of the tank towards the center of the tank. Each of the heat exchanger units comprises spaced-apart top and bottom walls or plates which have a plurality of spaced-apart baffle plates secured thereto and extending therebetween to define a plurality of baffles or passageways within the heat exchanger. An inlet valve or pipe is in communication with the inner end of each of the heat exchanger units with the baffle plates being arranged so that heated water or steam is directed back and forth through the heat exchanger for subsequent discharge through a discharge pipe or valve extending downwardly from the heat exchanger unit through the tank. The peripheries of the heat exchanger units are supported by and secured to the side walls and end of the tank so that a sealed compartment or dead air space is created below the heat exchanger thereby reducing the heat sink effect of the tank saddles and under frames attached to the tank.

DESCRIPTION OF THE PREFERRED EMBODIMENT

The numeral 10 refers to a conventional railway tank car comprising a wheeled support 12 of conventional design. Storage container or tank 14 is mounted on the frame 12 by conventional structure such as by tank saddles 16. Tank 14 generally has a cylindrical configuration although the bottom 18 of the tank 14 slopes inwardly from the ends or tank heads 20 and 22 towards a discharge valve assembly 26. It is to this conventional tank car structure that the heat exchanger of this invention is mounted and which will be referred to generally by the reference numeral 28.

Heat exchanger 28 comprises heat exchanger unit 30 and 30' which are identical except for being mirror images of each other. Inasmuch as units 30 and 30' are identical, only unit 30 will be described in detail with "'" being indicated on unit 30' to indicate identical structure.

Heat exchanger unit 30 comprises arcuate top and bottom plates 32 and 34 having a plurality of baffle plates 36 secured thereto and extending therebetween as best illustrated in FIG. 1 to create a plurality of passageways 38 therebetween. The peripheries of plates 32 and 34 are secured together and sealed by a wall member 40 extending therearound and define therewith a heat exchanger medium containing chamber 43. As seen in FIG. 1, the inner end of wall 40 is curved at 41 so as to conform to the configuration of the upper end of the discharge valve 26. The numeral 42 refers to an inlet extending upwardly through the bottom of the tank 14 and in communication with the interior of the heat exchanger as best seen in FIGS. 2 and 3. Outlet 44 also extends upwardly through the bottom of the tank 14 and is in communication with the interior of the heat exchanger is illustrated in FIG. 2.

More specifically, the heat exchanger unit 30 is defined as follows.

The heat exchanger outer wall 40 has a curved outer end portion 40*a*, a flat inner end portion 40*b* with a curved tank outlet surrounding portion 40*c*, and longitudinally extending flat side portions 40*e* and 40*f* that converge inwardly toward one another.

The baffle plates 36 includes U-shaped outer baffle plate member 33 surrounded by wall 40 and having outer longitudinally extending legs 33*a*, 33*b* that diverge outwardly from one another, the outer ends 33*c* of legs 33*a*, 33*b* being spaced away from curved end portion 40*a*; and laterally extending inner end portion 33*d* that has a central curved portion 33*e* going around part of the tank drain 26 and having U-shaped outwardly directed bight portion 33*f* surrounding the inlet 42.

The baffle further includes longitudinally elongated fins or plates 35,35 adjacent wall portion 40*b* and connecting with the curved portion 40*a* and extending short of the inner end portion 33*d*; a hairpin shaped longitudinally extending central baffle plate 37 having outwardly diverging leg portions 37*a*, 37*a* ending short of the outer curved portion 40*a*, and inner curved end portion 37*b* curved around part of heat exchanger outlet 44; and a shortened central plate 39 that extends in slightly between leg portions 37*a*, 37*a*.

The heat exchanger 30' has the same baffle construction and need not be described further.

The numerals 46 and 48 refer to tubing provided at the upper surface of the bottom plate 34 to assist in draining the condensate in the heat exchanger unit toward the outlet or discharge 44. The baffles 36 are provided with openings 49 at the tubes 46 and 48 to enable the condensate in the passageways to flow through the baffle plates so that the condensate is discharged closely adjacent the outlet 44.

Bars 50 and 52 are welded to the interior surface of the sides of the tank as seen in FIG. 3. Bars or brackets 54 and 56 are secured to the sides of the heat exchanger unit 30 and are welded to the bars 50 and 52 respectively. A bar or bracket 58 is secured to the outer end of the heat exchanger unit 30 and is welded to the interior surface of the tank head or end 22.

The conventional tank car 10 may be converted to the heated tank car of this invention by first removing a portion or all of the ends or heads 20 and 22. Preferably, the bars 50 and 52 would then be welded to the interior surfaces of the side walls of the tank. The heat exchanger units 30 and 30' are then inserted into the interior of the tank so that the brackets 54 and 56 rest upon the bars 50 and 52 respectively and so that the inner end of the units are positioned adjacent the discharge valve 26. The tank bottom 18 would have been previously cut away to provide the inlets and outlets of the heat exchanger to extend downwardly through the bottom 18 of the car. The heads 20 and 22 are then replaced in conventional fashion with the brackets 58 and 58' then being welded in a continuous fashion to the interior surfaces of tank heads. The brackets 54 and 56 are also welded to the bars 50 and 52. Preferably, the inner ends of the heat exchanger units would also be welded together so that a sealed compartment or dead air space 60 is created below the heat exchanger and above the bottom 18.

In use, assuming that the car contained a liquid commodity, steam or hot water would be connected to the inlets 42 and 42'. The incoming steam passes around the discharge valve 26 and then travels to the paths defined by the arrows in FIG. 1 for subsequent discharge through the outlets 44 and 44'. Heating of the material (lading) by the heat exchanger would initially cause the material in contact with the heat exchanger to flow towards the discharge valve 26 assisted by the weight of the material on top. This method of heating the lading eliminates part of the material being overheated awaiting for the material to start flowing downwardly through the discharge valve. The provision of the space 60 between the heat exchanger and the bottom of the tank prevents the undercarriage and saddles of the car from acting as heat sinks so that a much more efficient heating of the lading is obtained. The fact that the heat exchanger slopes towards the discharge valve assists the flow of material to the discharge valve 26.

Thus it can be seen that a novel heated tank car has been provided which provides a more efficient heating of the lading and which eliminates the formation of a "boot" of material at the bottom of the car. It can also be seen that the sloping of the heat exchanger unit and the elements 46 and 48 aid in the prevention of condensate accumulating in the heat exchanger thereby eliminating the serious problem of corrosion normally associated with prior art devices.

Thus it can be seen that the invention accomplishes at least all of its stated objectives.

I claim:

1. The method of converting a railway tank car of generally horizontally disposed annular shape with opposite ends and an annular portion extending therebetween and having a discharge valve assembly; the steps of:

removing at least a portion of one end of said tank car, inserting an elongated arcuately-shaped heat exchanger into said tank car through said one end, positioning said heat exchanger in said tank car so that said heat exchanger extends continuously incliningly downwardly between the side walls of said annular portion above the bottom of said tank car, with a portion of the heat exchanger being in substantially encompassing heat exchange relationship with the discharge valve assembly within the container, providing an inlet and an outlet in the tank adjacent said discharge valve assembly for the inlet and the outlet in said heat exchanger to permit a heated medium to be passed through said heat exchanger to heat the lading in said tank car, securing one end of the heat exchanger adjacent said discharge valve assembly, securing sides of said heat exchanger to said annular portion, replacing that portion of the said one end of said tank car previously removed, and securing the other end of said heat exchanger to said one end of the tank car whereby said heat exchanger creates a compartment portion therebelow which is sealed from the interior of said tank car which is above said heat exchanger.

2. The method of converting a tank, having a discharge valve, into a heated tank to facilitate dispensing a congealable stored medium, comprising the steps of:

removing at least a portion of said tank to expose the interior of said tank, inserting a heat exchanger into said interior of said tank, positioning said heat exchanger in said tank so that said heat exchanger slants toward said discharge valve and is in heat transfer relationship therewith, said heat exchanger extending continuously on inside walls of said tank and being spaced from the bottom of said tank, said heat exchanger encompassing at least a portion of said discharge valve, providing an inlet and an outlet in said heat exchanger, adjacent said discharge valve, securing peripheral edges of the heat exchanger to the interior walls of said tank whereby said heat exchanger creates a sealed compartment defining a dead air space and replacing said removed portion of the tank.

3. The method according to claim 2 wherein an inlet and an outlet are provided in the tank adjacent said discharge valve for accepting the inlet and the outlet in said heat exchanger to permit a heated medium to be passed through said heat exchanger to heat the congealable medium in said tank.

4. The method according to claim 2 wherein the compartment is sealed from the interior of the tank.

* * * * *